US009898954B2

(12) United States Patent
Chen

(10) Patent No.: US 9,898,954 B2
(45) Date of Patent: Feb. 20, 2018

(54) LIQUID CRYSTAL PANEL COMMON ELECTRODE VOLTAGE ADJUSTMENT DEVICE AND LIQUID CRYSTAL PANEL COMMON ELECTRODE VOLTAGE ADJUSTMENT METHOD

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 77 days.

(21) Appl. No.: 14/909,085

(22) PCT Filed: Dec. 2, 2015

(86) PCT No.: PCT/CN2015/096223
§ 371 (c)(1),
(2) Date: Jan. 29, 2016

(87) PCT Pub. No.: WO2017/012237
PCT Pub. Date: Jan. 26, 2017

(65) Prior Publication Data

US 2017/0162100 A1 Jun. 8, 2017

(30) Foreign Application Priority Data

Jul. 22, 2015 (CN) ..... 2015 1 0435532

(51) Int. Cl.
*G09G 3/20* (2006.01)
*G09G 3/36* (2006.01)

(52) U.S. Cl.
CPC ..... *G09G 3/2007* (2013.01); *G09G 3/3648* (2013.01); *G09G 2320/0247* (2013.01); *G09G 2320/043* (2013.01)

(58) Field of Classification Search
CPC ..... G09G 2310/027; G09G 2310/0272; G09G 2310/0275; G09G 2310/0278;
(Continued)

(56) References Cited

U.S. PATENT DOCUMENTS 5,734,158 A * 3/1998 Nagashima ..... G02F 1/1309 250/225
5,764,209 A * 6/1998 Hawthorne ..... G06F 11/2221 345/87

(Continued)

FOREIGN PATENT DOCUMENTS

CN 101086569 A 12/2007
CN 101320541 A 12/2008

(Continued)

*Primary Examiner* — Grant Sitta
(74) *Attorney, Agent, or Firm* — Andrew C. Cheng

(57) ABSTRACT

The present invention provides a liquid crystal panel common electrode voltage adjustment device and a liquid crystal panel common electrode voltage adjustment method. The liquid crystal panel common electrode voltage adjustment device includes a detection unit, a data collection unit, a process unit and an adjustment unit, and the detection unit detects a flicker condition of the liquid crystal panel in an activation state, and the data collection unit collects a common voltage value as the flicker exceeds a predetermined range to obtain a first common voltage, and the process unit obtains a control signal according to the first common voltage, and the adjustment unit sends a corresponding adjustment signal, and the adjustment signal adjusts the common voltage to be a second common voltage, and as the second common voltage is applied to the liquid
(Continued)

crystal panel, the flicker of the liquid crystal panel is controlled in the predetermined range.

4 Claims, 2 Drawing Sheets

(58) Field of Classification Search
CPC ..... G09G 2310/0297; G09G 3/20; G09G 3/2003; G09G 3/2007; G09G 3/2011; G09G 3/2014; G09G 3/2018; G09G 3/2022; G09G 3/2025; G09G 3/2029; G09G 3/3648; G09G 2320/043; G09G 2320/0247
USPC ..... 345/690
See application file for complete search history.

(56) References Cited

U.S. PATENT DOCUMENTS 5,793,221 A * 8/1998 Aoki ..... G02F 1/1309 324/760.01
5,926,157 A * 7/1999 Moon ..... G09G 3/3648 345/58
6,593,921 B2 * 7/2003 Nakanishi ..... G09G 3/36 324/760.01
7,212,024 B2 * 5/2007 Iwasaki ..... G02F 1/1309 324/759.03
7,990,363 B2 * 8/2011 Tseng ..... G09G 3/3655 345/103
8,184,113 B2 * 5/2012 Huang ..... G09G 3/3611 345/212
8,436,632 B2 * 5/2013 Baek ..... G09G 3/006 324/760.01
9,589,825 B2 * 3/2017 Sun ..... H01L 21/6838
2003/0052853 A1 * 3/2003 Wu ..... G09G 3/3611 345/90
2006/0145986 A1 * 7/2006 Oh ..... G09G 3/006 345/92
2007/0057975 A1 * 3/2007 Oh ..... G09G 3/3648 345/690
2007/0164963 A1 7/2007 Kim
2008/0111805 A1 * 5/2008 Chang ..... G09G 3/006 345/208

FOREIGN PATENT DOCUMENTS

CN 101452675 A 6/2009
CN 101615382 A 12/2009
CN 101937634 A 1/2011
CN 102467862 A 5/2012
CN 102708821 A 10/2012
CN 104217687 A 12/2014
CN 104766582 A 7/2015
CN 104851407 A 8/2015
CN 105096855 A 11/2015
CN 105096901 A 11/2015
TW 200828211 A 7/2008

* cited by examiner

LIQUID CRYSTAL PANEL COMMON ELECTRODE VOLTAGE ADJUSTMENT DEVICE AND LIQUID CRYSTAL PANEL COMMON ELECTRODE VOLTAGE ADJUSTMENT METHOD

CROSS REFERENCE

This application claims the priority of Chinese Patent Application No. 201510435532.2, entitled "Liquid crystal panel common electrode voltage adjustment device and liquid crystal panel common electrode voltage adjustment method", filed on Jul. 22, 2015, the disclosure of which is incorporated herein by reference in its entirety.

FIELD OF THE INVENTION

The present invention relates to a flat panel display field, and more particularly to a liquid crystal panel common electrode voltage adjustment device and a liquid crystal panel common electrode voltage adjustment method.

BACKGROUND OF THE INVENTION

The Liquid Crystal Display (LCD) is a common display device, and possesses properties of low power consumption, small volume and light weight. Therefore, it has been favored by the users. The liquid crystal display generally comprises the backlight module and the liquid crystal panel. The backlight module is employed to provide a plane light source for the liquid crystal panel, and the liquid crystal panel is employed for showing pictures, texts. In the driving circuit of the liquid crystal panel, the P-gamma chip provides the driving voltages of respective gray scales to the liquid crystal panel, and the driving voltage performs polarity reversal. Therefore, the driving voltage is symmetrical relative to the center of the common voltage (VCOM). In other words, the common voltage is at the position where the polarity reversal driving voltage is symmetrical. When the common voltage is at the position where the polarity reversal driving voltage is symmetrical, the flicker generated by the liquid crystal panel is the smallest. In general, the driving voltage and the common voltage of the liquid crystal panel are set at the position of the smallest flicker as the common voltage is at the 128th gray scale. However, due to the unstability and the aging of the thin film transistors in the liquid crystal panel, the outputted common voltage will decay or change inside the liquid crystal panel. The common electrode and the driving voltage which the liquid crystal molecules actually accept will change along with the various positions of the liquid crystal panel and the various lighting period. Therefore, the driving voltage will be no longer symmetrical relative to the common voltage. Meanwhile, with the increase of the lighting period of the liquid crystal panel, the drift phenomenon of the common voltage gets more serious. The degree of asymmetry of the driving voltage relative to the common voltage increases, accordingly. The flicker of the liquid crystal panel is amplified, and thus to influence the display quality of the liquid crystal panel.

SUMMARY OF THE INVENTION

The present invention provides a liquid crystal panel common electrode voltage adjustment device, wherein the liquid crystal panel common electrode voltage adjustment device is employed to adjust a common voltage of a liquid crystal panel, and the liquid crystal panel common electrode voltage adjustment device comprises a detection unit, a data collection unit, a process unit and an adjustment unit, and the detection unit is employed to detect a flicker condition of the liquid crystal panel in an activation state, and the data collection unit is electrically coupled to the detection unit, and employed to collect a common voltage value as the flicker of the liquid crystal panel exceeds a predetermined range to obtain a first common voltage, and the process unit is electrically coupled to the data collection unit, and employed to obtain a control signal according to the first common voltage, and the adjustment unit is electrically coupled to the process unit, and employed to send a corresponding adjustment signal according to the control signal, and the adjustment signal is employed to adjust the common voltage of the liquid crystal panel to be a second common voltage, and as the second common voltage is applied to the liquid crystal panel, the flicker of the liquid crystal panel is controlled in the predetermined range.

The data collection unit is employed to collect initial common voltages as the liquid crystal panel is at various gray scales, and to collect first common voltages as the liquid crystal panel is at various gray scales and after a predetermined period, and the process unit makes the initial common voltage minus the first common voltage as the liquid crystal panel is at the same gray scale to obtain a common voltage difference as the liquid crystal panel is at the same gray scale according to the initial common voltages as the liquid crystal panel is at various gray scales and the first common voltages as the liquid crystal panel is at various gray scales and after the predetermined period, and averages the common voltage differences as the liquid crystal panel is at all gray scales to obtain an average common voltage difference of the liquid crystal panel, and the process unit obtains the control signal according to the average common voltage difference, and the second common voltage is equal to the initial common voltage plus the average common voltage difference.

As the data collection unit collects the initial common voltages as the liquid crystal panel is at various gray scales, an initial common voltage as the liquid crystal panel is at 2n gray scale is collected, wherein n is a natural number, and 2n is smaller than or equal to 255.

The data collection unit is employed to respectively collect initial common voltages as the liquid crystal panel is at the 0th gray scale and the 255th gray scale, and to collect first common voltages as the liquid crystal panel is at the 0th gray scale and the 255th gray scale, and the process unit respectively obtains common voltage differences as the liquid crystal panel is at the 0th gray scale and the 255th gray scale according to the initial common voltages and the first common voltages as the liquid crystal panel is at the 0th gray scale and the 255th gray scale, and averages the common voltage differences as the liquid crystal panel is at the 0th gray scale and the 255th gray scale to obtain an average common voltage difference of the liquid crystal panel, and the process unit obtains the control signal according to the average common voltage difference, and the second common voltage is equal to the initial common voltage plus the average common voltage difference.

The data collection unit is employed to respectively collect initial common voltages as the liquid crystal panel is at the lowest gray scale that the detection unit can detect and the 255th gray scale, and to collect first common voltages as the liquid crystal panel is at the lowest gray scale that the detection unit can detect and the 255th gray scale, and the process unit respectively obtains common voltage differences as the liquid crystal panel is at the lowest gray scale that the detection unit can detect and the 255th gray scale according to the initial common voltages and the first common voltages as the liquid crystal panel is at the lowest gray scale that the detection unit can detect and the 255th gray scale, and averages the common voltage differences as the liquid crystal panel is at the lowest gray scale that the detection unit can detect and the 255th gray scale to obtain an average common voltage difference of the liquid crystal panel, and the process unit obtains the control signal according to the average common voltage difference, and the second common voltage is equal to the initial common voltage plus the average common voltage difference.

In comparison with prior art, in the liquid crystal panel common electrode voltage adjustment device, the data collection unit can collect the common voltage values to obtain the first common voltage as the flicker of the liquid crystal panel exceeds the predetermined range and the detection unit detects the condition that the liquid crystal panel has flickers. Moreover, the process unit obtains the control signal according to the first common voltage, and the adjustment unit adjusts the common voltage applied to the liquid crystal panel to be the second common voltage according to the control signal, and as the second common voltage is applied to the liquid crystal panel, the flicker of the liquid crystal panel is controlled in the predetermined range, and thus to promote the display quality of the liquid crystal panel.

The present invention provides a liquid crystal panel common electrode voltage adjustment method, wherein the liquid crystal panel common electrode voltage adjustment method is employed to adjust a common voltage of a liquid crystal display, and the liquid crystal panel common electrode voltage adjustment method comprises:

detecting a flicker condition of the liquid crystal panel in an activation state;

collecting a common voltage value as the flicker of the liquid crystal panel exceeds a predetermined range to obtain a first common voltage;

obtaining a control signal according to the first voltage;

sending a corresponding adjustment signal according to the control signal, and the adjustment signal is employed to adjust the common voltage of the liquid crystal panel to be a second common voltage, and as the second common voltage is applied to the liquid crystal panel, the flicker of the liquid crystal panel is controlled in the predetermined range.

The step of collecting a common voltage value as the flicker of the liquid crystal panel exceeds a predetermined range to obtain a first common voltage comprises:

collect initial common voltages as the liquid crystal panel is at various gray scales, and to collect first common voltages as the liquid crystal panel is at various gray scales and after a predetermined period;

the step of obtaining a control signal according to the first voltage comprises:

making the initial common voltage minus the first common voltage as the liquid crystal panel is at the same gray scale to obtain a common voltage difference as the liquid crystal panel is at the same gray scale according to the initial common voltages as the liquid crystal panel is at various gray scales and the first common voltages as the liquid crystal panel is at various gray scales and after the predetermined period, and averaging the common voltage differences as the liquid crystal panel is at all gray scales to obtain an average common voltage difference of the liquid crystal panel, and obtaining the control signal according to the average common voltage difference;

wherein the second common voltage is equal to the initial common voltage plus the average common voltage difference.

The step of collecting a common voltage value as the flicker of the liquid crystal panel exceeds a predetermined range to obtain a first common voltage comprises:

as the data collection unit collects the initial common voltages as the liquid crystal panel is at various gray scales, an initial common voltage as the liquid crystal panel is at 2n gray scale is collected, wherein n is a natural number, and 2n is smaller than or equal to 255.

The step of collecting a common voltage value as the flicker of the liquid crystal panel exceeds a predetermined range to obtain a first common voltage comprises:

respectively collecting initial common voltages as the liquid crystal panel is at the 0th gray scale and the 255th gray scale, and collecting first common voltages as the liquid crystal panel is at the 0th gray scale and the 255th gray scale;

the step of obtaining a control signal according to the first voltage comprises:

respectively obtaining common voltage differences as the liquid crystal panel is at the 0th gray scale and the 255th gray scale according to the initial common voltages and the first common voltages as the liquid crystal panel is at the 0th gray scale and the 255th gray scale, and averaging the common voltage differences as the liquid crystal panel is at the 0th gray scale and the 255th gray scale to obtain an average common voltage difference of the liquid crystal panel, and obtaining the control signal according to the average common voltage difference;

wherein the second common voltage is equal to the initial common voltage plus the average common voltage difference.

The step of collecting a common voltage value as the flicker of the liquid crystal panel exceeds a predetermined range to obtain a first common voltage comprises:

respectively collecting initial common voltages as the liquid crystal panel is at the lowest gray scale that can be detected and the 255th gray scale, and collecting first common voltages as the liquid crystal panel is at the lowest gray scale that can be detected and the 255th gray scale;

the step of obtaining a control signal according to the first voltage comprises:

respectively obtaining common voltage differences as the liquid crystal panel is at the lowest gray scale that can be detected and the 255th gray scale according to the initial common voltages and the first common voltages as the liquid crystal panel is at the lowest gray scale that can be detected and the 255th gray scale, and averaging the common voltage differences as the liquid crystal panel is at the lowest gray scale that can be detected and the 255th gray scale to obtain an average common voltage difference of the liquid crystal panel, and obtaining the control signal according to the average common voltage difference;

wherein the second common voltage is equal to the initial common voltage plus the average common voltage difference.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figure 1:
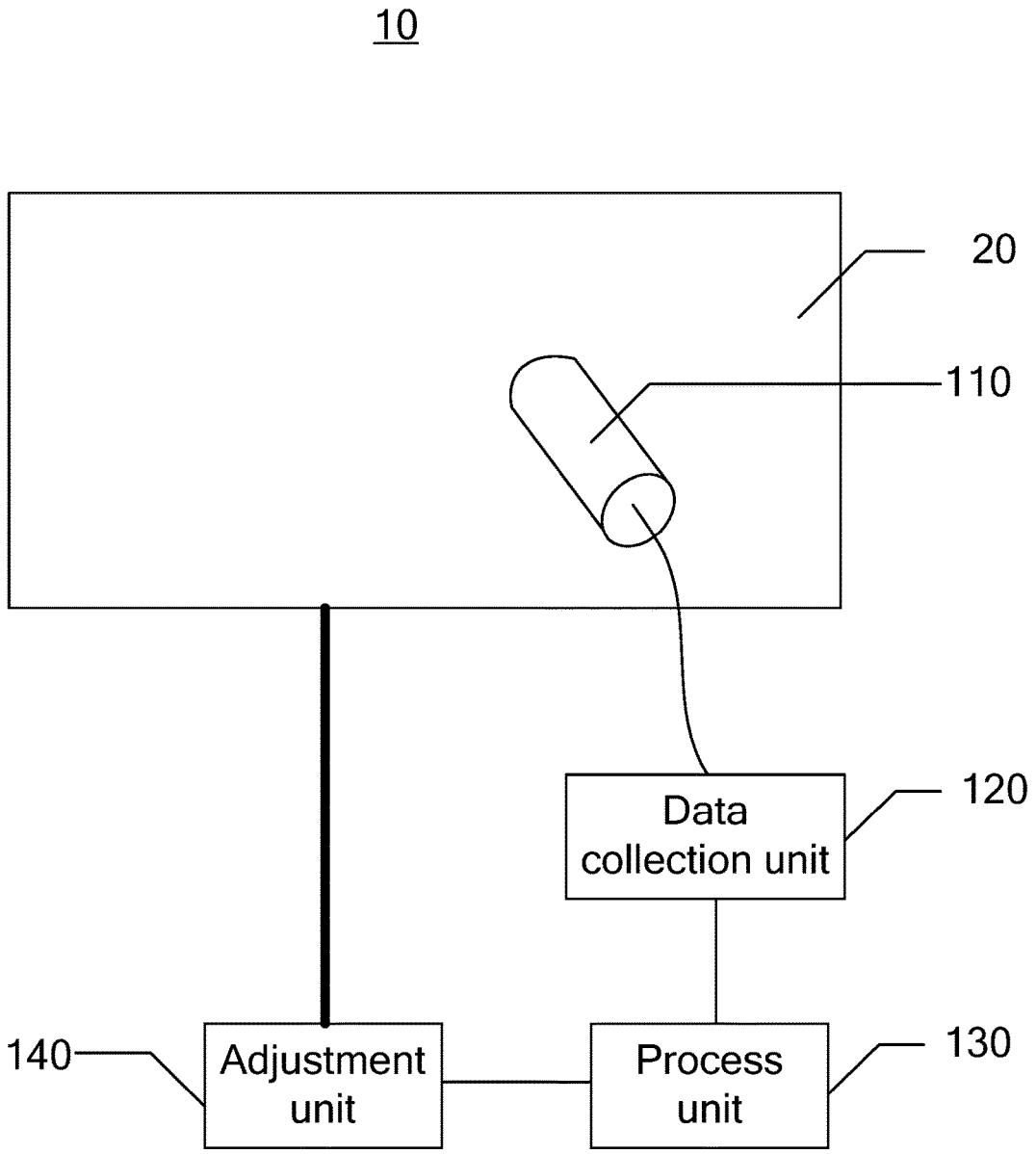
FIG. 1 is a diagram of a liquid crystal panel common electrode voltage adjustment device according to one preferred embodiment of the present invention.

Please refer to FIG. 1. FIG. 1 is a diagram of a liquid crystal panel common electrode voltage adjustment device according to one preferred embodiment of the present invention. The liquid crystal panel common electrode voltage adjustment device 10 of the present invention is employed to adjust a common voltage of the liquid crystal panel 20 to make the flicker of the liquid crystal panel 20 be controlled in a predetermined range. The liquid crystal panel common electrode voltage adjustment device 10 comprises a detection unit 110, a data collection unit 120, a process unit 130 and an adjustment unit 140. The detection unit 110 is employed to detect a flicker condition of the liquid crystal panel 20 in an activation state, and the data collection unit 120 is electrically coupled to the detection unit 110, and employed to collect a common voltage value as the flicker of the liquid crystal panel 20 exceeds a predetermined range to obtain a first common voltage. The process unit 130 is electrically coupled to the data collection unit 120, and employed to obtain a control signal according to the first common voltage. The adjustment unit 140 is electrically coupled to the process unit 130, and employed to send a corresponding adjustment signal according to the control signal, and the adjustment signal is employed to adjust the common voltage of the liquid crystal panel to be a second common voltage. As the second common voltage is applied to the liquid crystal panel, the flicker of the liquid crystal panel is controlled in the predetermined range.

In one embodiment, the data collection unit 120 is employed to collect initial common voltages as the liquid crystal panel 20 is at various gray scales, and to collect first common voltages as the liquid crystal panel 20 is at various gray scales and after a predetermined period. The process unit 130 makes the initial common voltage minus the first common voltage as the liquid crystal panel 20 is at the same gray scale to obtain a common voltage difference as the liquid crystal panel 20 is at the same gray scale according to the initial common voltages as the liquid crystal panel is at various gray scales and the first common voltages as the liquid crystal panel 20 is at various gray scales and after the predetermined period, and averages the common voltage differences as the liquid crystal panel is at all gray scales to obtain an average common voltage difference of the liquid crystal panel 20. The process unit 130 obtains the control signal according to the average common voltage difference, and the second common voltage is equal to the initial common voltage plus the average common voltage difference.

It is understandable that as the data collection unit 120 collects the initial common voltages as the liquid crystal panel 20 is at various gray scales, an initial common voltage as the liquid crystal panel 20 is at 2n gray scale is collected, wherein n is a natural number, and 2n is smaller than or equal to 255.

In another embodiment, the data collection unit 120 is employed to respectively collect initial common voltages as the liquid crystal panel is at the 0th gray scale and the 255th gray scale, and to collect first common voltages as the liquid crystal panel is at the 0th gray scale and the 255th gray scale. The process unit 130 respectively obtains common voltage differences as the liquid crystal panel 20 is at the 0th gray scale and the 255th gray scale according to the initial common voltages and the first common voltages as the liquid crystal panel 20 is at the 0th gray scale and the 255th gray scale, and averages the common voltage differences as the liquid crystal panel 20 is at the 0th gray scale and the 255th gray scale to obtain an average common voltage difference of the liquid crystal panel 20. The process unit 130 obtains the control signal according to the average common voltage difference. Then, the second common voltage is equal to the initial common voltage plus the average common voltage difference.

In another embodiment, the data collection unit 130 is employed to respectively collect initial common voltages as the liquid crystal panel 20 is at the lowest gray scale that the detection unit 110 can detect and the 255th gray scale, and to collect first common voltages as the liquid crystal panel 20 is at the lowest gray scale that the detection unit 110 can detect and the 255th gray scale, and to respectively obtain common voltage differences as the liquid crystal panel 20 is at the lowest gray scale that the detection unit 110 can detect and the 255th gray scale, and averages the common voltage differences as the liquid crystal panel 20 is at the lowest gray scale that the detection unit 110 can detect and the 255th gray scale to obtain an average common voltage difference of the liquid crystal panel 20. The process unit 130 obtains the control signal according to the average common voltage difference, and the second common voltage is equal to the initial common voltage plus the average common voltage difference.

In comparison with prior art, in the liquid crystal panel common electrode voltage adjustment device 10, the data collection unit 120 can collect the common voltage values to obtain the first common voltage as the flicker of the liquid crystal panel 20 exceeds the predetermined range and the detection unit 110 detects the condition that the liquid crystal panel 20 has flickers. Moreover, the process unit 130 obtains the control signal according to the first common voltage, and the adjustment unit 140 adjusts the common voltage applied to the liquid crystal panel 20 to be the second common voltage according to the control signal, and as the second common voltage is applied to the liquid crystal panel 20, the flicker of the liquid crystal panel is controlled in the predetermined range, and thus to promote the display quality of the liquid crystal panel 20.

Figure 2:
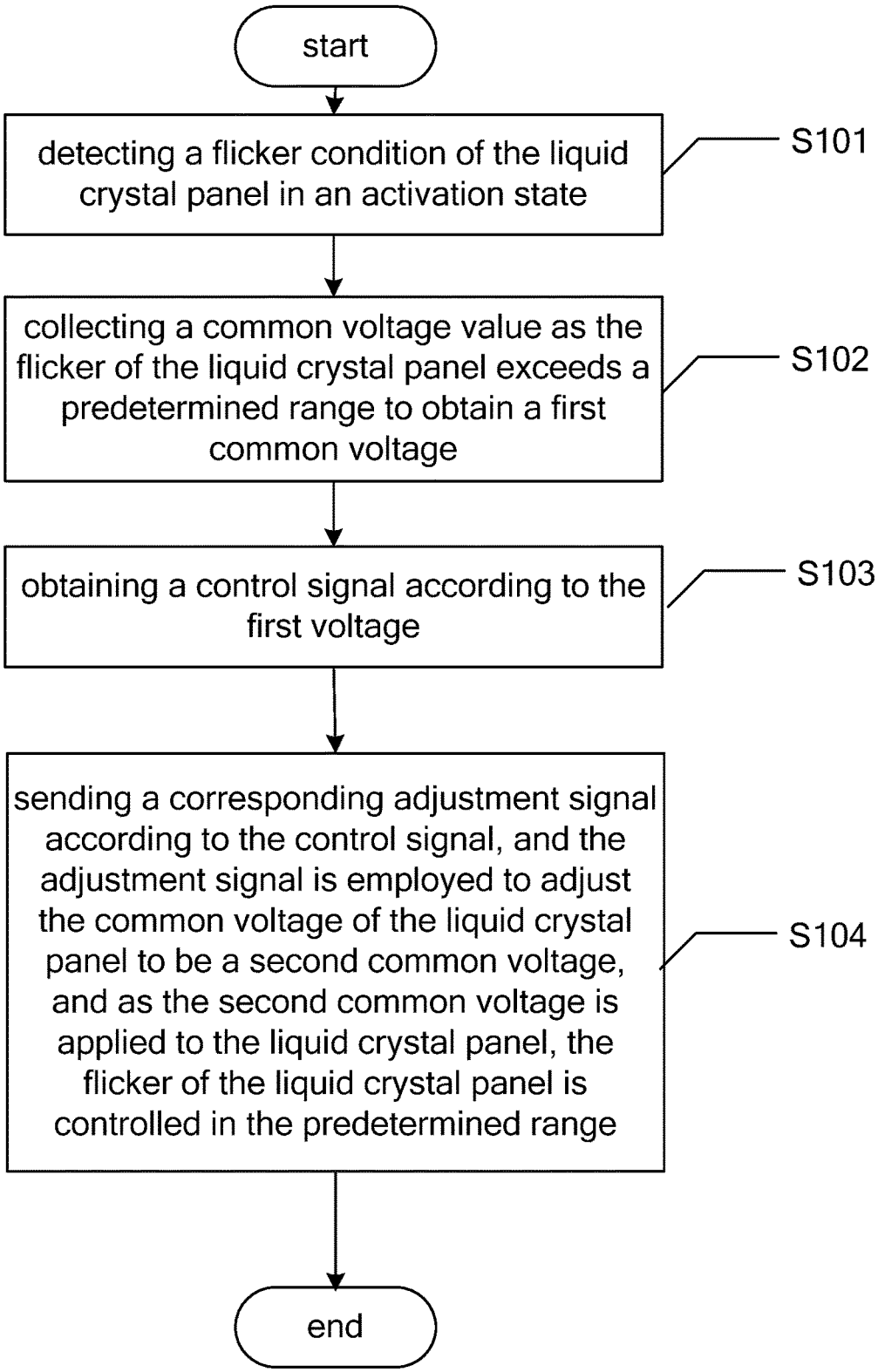
FIG. 2 is a flowchart diagram of a liquid crystal panel common electrode voltage adjustment method according to one preferred embodiment of the present invention.

The liquid crystal panel common electrode voltage adjustment method of the present invention is introduced below with combination of FIG. 1. Please refer to FIG. 2. FIG. 2 is a flowchart diagram of a liquid crystal panel common electrode voltage adjustment method according to one preferred embodiment of the present invention. The liquid crystal panel common electrode voltage adjustment method comprises the following steps but not limited thereto.

Step S101, detecting a flicker condition of the liquid crystal panel 20 in an activation state. Specifically, the detection unit 110 detects a flicker condition of the liquid crystal panel 20 in an activation state.

Step S102, collecting a common voltage value as the flicker of the liquid crystal panel 20 exceeds a predetermined range to obtain a first common voltage. Specifically, the data collection unit 120 collects a common voltage value as the flicker of the liquid crystal panel 20 exceeds a predetermined range to obtain a first common voltage.

Step S103, obtaining a control signal according to the first voltage. Specifically, the process unit 130 obtains a control signal according to the first voltage.

Step S104, sending a corresponding adjustment signal according to the control signal, and the adjustment signal is employed to adjust the common voltage of the liquid crystal panel to be a second common voltage, and as the second common voltage is applied to the liquid crystal panel, the flicker of the liquid crystal panel is controlled in the predetermined range. Specifically, the adjustment unit 140 is employed to send a corresponding adjustment signal according to the control signal, and the adjustment signal is employed to adjust the common voltage of the liquid crystal panel 20 to be a second common voltage, and as the second common voltage is applied to the liquid crystal panel 20, the flicker of the liquid crystal panel 20 is controlled in the predetermined range.

In one embodiment, the Step S102, collecting a common voltage value as the flicker of the liquid crystal panel 20 exceeds a predetermined range to obtain a first common voltage comprises: collecting initial common voltages as the liquid crystal panel 20 is at various gray scales, and collecting first common voltages as the liquid crystal panel 20 is at various gray scales and after a predetermined period. Correspondingly, the step of Step S103, obtaining a control signal according to the first voltage comprises: making the initial common voltage minus the first common voltage as the liquid crystal panel 20 is at the same gray scale to obtain a common voltage difference as the liquid crystal panel 20 is at the same gray scale according to the initial common voltages as the liquid crystal panel 20 is at various gray scales and the first common voltages as the liquid crystal panel 20 is at various gray scales and after the predetermined period, and averaging the common voltage differences as the liquid crystal panel 20 is at all gray scales to obtain an average common voltage difference of the liquid crystal panel 20, and obtaining the control signal according to the average common voltage difference. In this embodiment, the second common voltage is equal to the initial common voltage plus the average common voltage difference.

Furthermore, the step of Step S102, collecting a common voltage value as the flicker of the liquid crystal panel 20 exceeds a predetermined range to obtain a first common voltage comprises: collecting an initial common voltage as the liquid crystal panel 20 is at 2n gray scale, wherein n is a natural number, and 2n is smaller than or equal to 255 as the data collection unit collects the initial common voltages as the liquid crystal panel 20 is at various gray scales.

In another embodiment, the step of Step S102, collecting a common voltage value as the flicker of the liquid crystal panel 20 exceeds a predetermined range to obtain a first common voltage comprises: respectively collecting initial common voltages as the liquid crystal panel 20 is at the 0th gray scale and the 255th gray scale, and to collect first common voltages as the liquid crystal panel 20 is at the 0th gray scale and the 255th gray scale. Correspondingly, the step of Step S103, obtaining a control signal according to the first voltage comprises: respectively obtaining common voltage differences as the liquid crystal panel 20 is at the 0th gray scale and the 255th gray scale according to the initial common voltages and the first common voltages as the liquid crystal panel 20 is at the 0th gray scale and the 255th gray scale, and averaging the common voltage differences as the liquid crystal panel 20 is at the 0th gray scale and the 255th gray scale to obtain an average common voltage difference of the liquid crystal panel 20, and obtaining the control signal according to the average common voltage difference. Then, the second common voltage is equal to the initial common voltage plus the average common voltage difference.

In another embodiment, the step of Step S102, collecting a common voltage value as the flicker of the liquid crystal panel 20 exceeds a predetermined range to obtain a first common voltage comprises: respectively collecting initial common voltages as the liquid crystal panel 20 is at the lowest gray scale that can be detected and the 255th gray scale, and collecting first common voltages as the liquid crystal panel 20 is at the lowest gray scale that can be detected and the 255th gray scale. Correspondingly, the step of Step S103, obtaining a control signal according to the first voltage comprises: respectively obtaining common voltage differences as the liquid crystal panel 20 is at the lowest gray scale that can be detected and the 255th gray scale according to the initial common voltages and the first common voltages as the liquid crystal panel 20 is at the lowest gray scale that can be detected and the 255th gray scale, and averaging the common voltage differences as the liquid crystal panel 20 is at the lowest gray scale that can be detected and the 255th gray scale to obtain an average common voltage difference of the liquid crystal panel 20, and obtaining the control signal according to the average common voltage difference. Then, the second common voltage is equal to the initial common voltage plus the average common voltage difference.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal panel common electrode voltage adjustment method, wherein the liquid crystal panel common electrode voltage adjustment method is employed to adjust a common voltage of a liquid crystal display, and the liquid crystal panel common electrode voltage adjustment method comprises:

detecting a flicker condition of the liquid crystal panel in an activation state;

collecting a common voltage value as the liquid crystal panel is at various gray scales as the flicker of the liquid crystal panel exceeds a predetermined range and collecting first common voltages as the liquid crystal panel is at various gray scales and after a predetermined period;

making the initial common voltage minus the first common voltage as the liquid crystal panel is at the same gray scale to obtain a common voltage difference as the liquid crystal panel is at the same gray scale according to the initial common voltages as the liquid crystal panel is at various gray scales and the first common voltages as the liquid crystal panel is at various gray scales and after the predetermined period, and averaging the common voltage differences as the liquid crystal panel is at all gray scales to obtain an average common voltage difference of the liquid crystal panel, and obtaining the control signal according to the average common voltage difference;

sending a corresponding adjustment signal according to the control signal, and the adjustment signal is employed to adjust the common voltage of the liquid crystal panel to be a second common voltage, and as the second common voltage is applied to the liquid crystal panel, the flicker of the liquid crystal panel is controlled in the predetermined range wherein the second common voltage is equal to the initial common voltage plus the average common voltage difference.

2. The liquid crystal panel common electrode voltage adjustment method according to claim 1, wherein the step of collecting a common voltage value as the flicker of the liquid crystal panel exceeds a predetermined range to obtain a first common voltage comprises:

as the data collection unit collects the initial common voltages as the liquid crystal panel is at various gray scales, an initial common voltage as the liquid crystal panel is at 2n gray scale is collected, wherein n is a natural number, and 2n is smaller than or equal to 255.

3. The liquid crystal panel common electrode voltage adjustment method according to claim 1, wherein the step of collecting a common voltage value as the flicker of the liquid crystal panel exceeds a predetermined range to obtain a first common voltage comprises:

respectively collecting initial common voltages as the liquid crystal panel is at the 0th gray scale and the 255th gray scale, and collecting first common voltages as the liquid crystal panel is at the 0th gray scale and the 255th gray scale;

the step of obtaining the control signal comprises:

respectively obtaining common voltage differences as the liquid crystal panel is at the 0th gray scale and the 255th gray scale according to the initial common voltages and the first common voltages as the liquid crystal panel is at the 0th gray scale and the 255th gray scale, and averaging the common voltage differences as the liquid crystal panel is at the 0th gray scale and the 255th gray scale to obtain an average common voltage difference of the liquid crystal panel, and obtaining the control signal according to the average common voltage difference;

wherein the second common voltage is equal to the initial common voltage plus the average common voltage difference.

4. The liquid crystal panel common electrode voltage adjustment method according to claim 1, wherein the step of collecting a common voltage value as the flicker of the liquid crystal panel exceeds a predetermined range to obtain a first common voltage comprises:

respectively collecting initial common voltages as the liquid crystal panel is at the lowest gray scale that can be detected and the 255th gray scale, and collecting first common voltages as the liquid crystal panel is at the lowest gray scale that can be detected and the 255th gray scale;

the step of obtaining the control signal comprises:

respectively obtaining common voltage differences as the liquid crystal panel is at the lowest gray scale that can be detected and the 255th gray scale according to the initial common voltages and the first common voltages as the liquid crystal panel is at the lowest gray scale that can be detected and the 255th gray scale, and averaging the common voltage differences as the liquid crystal panel is at the lowest gray scale that can be detected and the 255th gray scale to obtain an average common voltage difference of the liquid crystal panel, and obtaining the control signal according to the average common voltage difference;

wherein the second common voltage is equal to the initial common voltage plus the average common voltage difference.

* * * * *